US008593233B1

(12) United States Patent
Goeke

(10) Patent No.: US 8,593,233 B1
(45) Date of Patent: Nov. 26, 2013

(54) COAXIAL CABLE MULTIPLEXOR

(75) Inventor: Wayne C. Goeke, Hudson, OH (US)

(73) Assignee: Keithley Instruments, Inc., Cleveland, OH (US)

( * ) Notice: Subject to any disclaimer, the term of this patent is extended or adjusted under 35 U.S.C. 154(b) by 398 days.

(21) Appl. No.: 13/048,685

(22) Filed: Mar. 15, 2011

(51) Int. Cl.
*H01P 5/12* (2006.01)
*H01P 3/08* (2006.01)

(52) U.S. Cl.
USPC ..... 333/105; 333/236

(58) Field of Classification Search
USPC ..... 333/101, 103, 104, 105, 123, 236, 237, 333/243
See application file for complete search history.

(56) References Cited

U.S. PATENT DOCUMENTS 2,644,926 A * 7/1953 Varela ..... 333/101
2,984,797 A * 5/1961 Wheeler ..... 333/105
4,081,767 A * 3/1978 Voss ..... 333/101
5,559,482 A 9/1996 Close
5,644,115 A 7/1997 Knauer
5,952,902 A * 9/1999 Kich et al. ..... 335/4
7,388,366 B2 6/2008 Goeke
7,920,038 B1 4/2011 Knauer
8,410,804 B1 * 4/2013 Goeke ..... 324/754.01

* cited by examiner

*Primary Examiner* — Dean O Takaoka
(74) *Attorney, Agent, or Firm* — Pearne & Gordon LLP

(57) ABSTRACT

A multiplexor includes an output having a characteristic impedance; a first input having a characteristic impedance equal to the output characteristic impedance; a second input; a first switch path including a first switch operable to connect/disconnect the first input center conductor and the output center conductor; a first input conductive path adjacent to the first switch path and being operable to provide the output characteristic impedance; a second switch path including a second switch operable to connect/disconnect the second input first signal conductor and the output center conductor; and a third switch path including a third switch operable to connect/disconnect the second input second signal conductor and the output intermediate conductor, the third switch path being operable to guard the second switch path when the third switch path is provided with a guard voltage.

2 Claims, 2 Drawing Sheets

COAXIAL CABLE MULTIPLEXOR

BACKGROUND OF THE INVENTION

The present invention relates to electrical test instruments and, in particular, to a coaxial cable multiplexor for test connections.

Often in present measurement regimes, it is necessary to re-cable the test setup depending on whether tests involve high frequency measurements or low frequency precision measurements. Such re-cabling adds time and uncertainty to the testing process.

SUMMARY OF THE INVENTION

A multiplexor includes an output including at least an output center conductor, an output intermediate conductor and an output outer conductor in coaxial arrangement, there being a characteristic impedance between the output center conductor and the output outer conductor; a first input including at least a first input center conductor and a first input outer conductor in coaxial arrangement, the first input having a characteristic impedance between the first input center conductor and the first input outer conductor equal to the output characteristic impedance; a second input including at least a second input first signal conductor and a second input second signal conductor; a first switch path including a first switch operable to connect/disconnect the first input center conductor and the output center conductor; a first input conductive path between the first input outer conductor and the output outer conductor, the first input conductive path being adjacent to the first switch path and being operable to provide the output characteristic impedance between the first input conductive path and the first switch path for signal frequencies that produce transmission line characteristics; a second switch path including a second switch operable to connect/disconnect the second input first signal conductor and the output center conductor; and a third switch path including a third switch operable to connect/disconnect the second input second signal conductor and said output intermediate conductor, the third switch path being adjacent the second switch path and being operable to guard the second switch path when the third switch path is provided with a guard voltage.

DETAILED DESCRIPTION OF THE INVENTION

Figure 1:
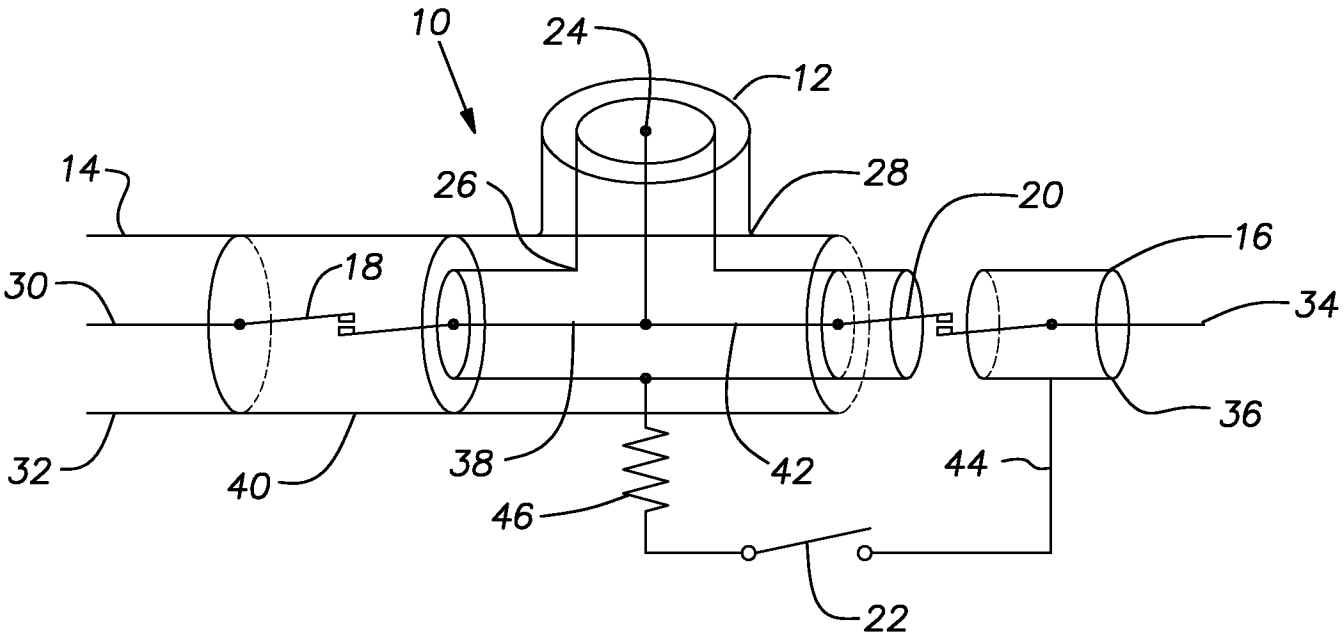
FIG. 1 is a schematic diagram of an example of an aspect of the invention.

Referring to FIG. 1, a multiplexor 10 includes an output 12, a first input 14, a second input 16, a first switch 18, a second switch 20, and a third switch 22.

The output 12 has a center conductor 24, an intermediate conductor 26 and an outer conductor 28 arranged coaxially.

The first input 14 has a center conductor 30 and an outer conductor 32.

The second input 16 has a first signal conductor 34 and a second signal conductor 36.

The output 12 has a characteristic impedance between the center conductor 24 and the outer conductor 28 for signal frequencies that produce transmission line characteristics, for example, high-frequency-rich signals such as radio frequencies and pulse waveforms.

The first input 14 has the same characteristic impedance as the output 12 between the center conductor 30 and the outer conductor 32.

The first switch 18 and the second switch 20 may be, for example, electromagnetic reed switches. The third switch 22 may be, for example, a solid state switch or relay.

The center conductor 30, the first switch 18 and the center conductor 24 determine a first switch path 38. The outer conductor 32 and the outer conductor 28 determine a first input conductive path 40. The first input conductive path 40 is adjacent to the first switch path 38. This operates to provide the characteristic impedance end to end. In this example, first input conductive path 40 surrounds the first switch path 38.

The first signal conductor 34, the second switch 20 and the center conductor 24 determine a second switch path 42. The second signal conductor 34, the switch 22 and intermediate conductor 26 determine a third switch path 44. The third switch path 44 is adjacent to the second switch path 42. If the third switch path 44 is connected to a buffered version of the voltage potential on the second switch path 42 (e.g., the output of an unshown buffer amplifier connected to a source of the voltage potential of the first signal conductor 34), the second switch path 42 is "guarded" from effects such as leakage current because the second switch path 42 only "sees" an equal potential. There is no potential difference, so there is no current. This applied voltage is the "guard voltage". When the third switch path 44 is provide with the guard voltage, the second switch path 42 is guarded. Guarding is often important in precision measurement of low frequency signals.

The resistor 46 can be added to minimize the effects of the stub leading to the switch 22 when the switches 20, 22 are open, switch 18 is closed and high frequencies are present on the input 14. The gap between the intermediate conductor 26 and the second signal conductor 36 should be minimized to maximize guarding.

Figure 2:
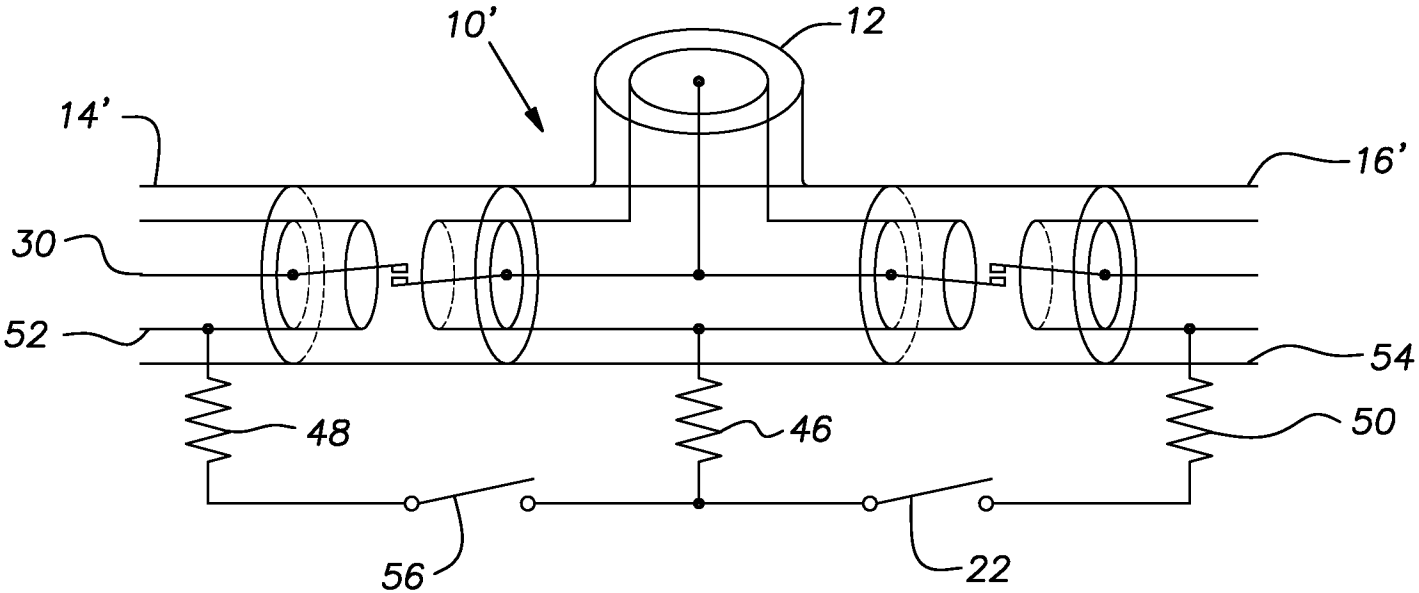
FIG. 2 is a schematic diagram of an example of another aspect of the invention.

Referring to FIG. 2, a multiplexor 10' is similar to the multiplexor of FIG. 1 except that both the first input 14' and the second input 16' can be used for maintaining characteristic impedance for high frequencies or guarding for precision low frequency measurements. In this case not only the resistor 46 can be added, but also the resistors 48, 50 can be added to minimize the effects of the switch stubs when high frequency signals are being used.

In FIG. 2, both inputs 14', 16', have triaxial conductors, thus adding a coaxial intermediate conductor 52 to the first input 14' and a coaxial outer conductor 54 to the second input 16' compared to FIG. 1. A switch 56 permits guarding of the center conductor 30 as described for the first signal conductor 34 in FIG. 1. The addition of the outer conductor 54 permits continuity of characteristic impedance for the second input 16' as described for the first input 14 of FIG. 1.

The adjectives center, intermediate and outer are intended to describe the recited conductors' locations relative to each other, rather than to limit the possible number of conductors in any cabling or corresponding connectors. The cables and connectors may be, for example, triaxial cables and connectors.

The present invention helps minimize re-cabling by making it possible to use the same cables for both high frequency and low frequency precision measurements. The multiplexor of the invention can be expanded from one-to-two to one-to-many and multiple instances can be used to create a full switch matrix.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A multiplexor, said multiplexor comprising:

an output including at least an output center conductor, an output intermediate conductor and an output outer conductor in coaxial arrangement, there being a characteristic impedance between said output center conductor and said output outer conductor;

a first input including at least a first input center conductor and a first input outer conductor in coaxial arrangement, the first input having a characteristic impedance between said first input center conductor and said first input outer conductor equal to said output characteristic impedance;

a second input including at least a second input first signal conductor and a second input second signal conductor;

a first switch path including a first switch operable to connect/disconnect said first input center conductor and said output center conductor;

a first input conductive path between said first input outer conductor and said output outer conductor, said first input conductive path being adjacent to said first switch path and being operable to provide said output characteristic impedance between the first input conductive path and the first switch path for signal frequencies that produce transmission line characteristics;

a second switch path including a second switch operable to connect/disconnect said second input first signal conductor and said output center conductor; and a third switch path including a third switch operable to connect/disconnect said second input second signal conductor and said output intermediate conductor, said third switch path being adjacent said second switch path and being operable to guard said second switch path when said third switch path is provided with a guard voltage.

2. A multiplexor according to claim 1, wherein said second input first signal conductor is a center conductor and said second input second signal conductor is a coaxial intermediate conductor, said second input further having a second input coaxial outer conductor and a second input conductive path between said second input outer conductor and said output outer conductor, said second input conductive path being adjacent to said second switch path and being operable to provide said output characteristic impedance between the conductive path and the first switch path for said signal frequencies that produce transmission line characteristics.

* * * * *